United States Patent [19]

Angus

[11] Patent Number: 5,060,847

[45] Date of Patent: Oct. 29, 1991

[54] FILM PROCESSING ENVELOPE WITH OPTIONAL REMOVABLE NEGATIVE POUCH

[75] Inventor: James G. Angus, Don Mills, Canada

[73] Assignee: Moore Business Forms, Inc., Grand Island, N.Y.

[21] Appl. No.: 561,990

[22] Filed: Aug. 1, 1990

[30] Foreign Application Priority Data

Sep. 29, 1989 [CA] Canada ..... 615027

[51] Int. Cl.[5] ..... B65D 27/08; B65D 27/14

[52] U.S. Cl. ..... 229/70; 229/72; 229/80

[58] Field of Search ..... 229/72, 68 R, 70, 80

[56] References Cited

U.S. PATENT DOCUMENTS

| | | | |
|---|---|---|---|
| 117,795 | 8/1871 | McMahan | 229/72 |
| 2,759,658 | 8/1956 | Sawdon | 229/73 |
| 2,956,726 | 10/1960 | Pieronek et al. | 229/72 |
| 3,030,004 | 4/1962 | Pieronek et al. | 229/72 |
| 3,111,256 | 11/1963 | Hiersteiner | 229/72 |
| 3,184,150 | 5/1965 | Hubbard | 229/73 |
| 3,368,741 | 2/1968 | Mercur | 229/68 |
| 3,380,576 | 4/1968 | Deimann | 229/80 |
| 3,467,299 | 9/1969 | Meyer | 229/70 |
| 3,652,007 | 3/1972 | MacDougall | 229/69 |
| 3,702,171 | 11/1972 | Levine | 229/80 |
| 3,718,276 | 2/1973 | Vandergrift et al. | 229/72 |
| 3,866,822 | 2/1975 | Faltin et al. | 229/69 |
| 3,933,094 | 1/1976 | Murphy et al. | 229/68 R |
| 4,047,661 | 9/1977 | Klein | 229/72 |

*Primary Examiner*—Stephen P. Garbe

*Attorney, Agent, or Firm*—Nixon & Vanderhye

[57] ABSTRACT

A film processing envelope is formed from a single preglued web and comprises a generally rectangular back panel and a generally rectangular front panel overlying the back panel and adhesively secured to the back panel along opposite edges, and by a fold line along bottom of the envelope. A closure flap is secured to the back panel along the top thereof by a fold line, and means are provided for securing the free edge of the closure flap, opposite the fold line, to the front panel when the closure flap is folded over the mouth of the envelope to overly a part of the front panel. The closure flap may be provided with an element which is either detachable before or after securement of the closure flap to the front panel. The envelope may be provided with a relatively shallow open topped pouch having a back detachably secured along the free edge of the front panel and the front connected to the bottom edge of the back along a fold line, with the front and back being adhesively connected along opposite sides. When provided with such additional pouch the closure flap, when folded over the envelope front panel, will extend beyond the pouch for securement to the front panel, so that the closure flap completely covers the pouch and serves to close the pouch as well as the envelope.

18 Claims, 6 Drawing Sheets

FILM PROCESSING ENVELOPE WITH OPTIONAL REMOVABLE NEGATIVE POUCH

This invention relates to film processing envelopes, and, particularly, to a film processing envelope which is optionally provided with a removable pouch adapted to retain negatives.

There are a variety of film processing envelopes available, although known envelopes lack one or more of the properties desirable for modern film processing. The envelopes should preferably be simple and relatively inexpensive to produce. Preferably, they should be produceable in a single continuous operation including single step printing of fixed and variable data, including bar coding for automated handling, gluing, folding, and detaching into individual envelopes ready for use. Preferably the envelope should be designed to incorporate a removable negative pouch where desirable, and the envelope should provide for incorporation of a detachable receipt stub, which, when film is left by a customer for processing, may be removed and given to the customer for proper identification of the processed film when the customer returns to pick it up.

It is also desirable for a film envelope to be constructed with a relatively wide mouth so that processed film, together with advertising or promotional materials, may be readily inserted into the envelope. It is also desirable that the envelope be provided with means for adhesively closing it for retention of the contents, and for repeated reopening and reclosure of the envelope so that the envelope may be used by the customer to securely store the processed film and prints, while permitting easy access to the contents of the envelope when the customer desires to display the prints.

In a broad aspect, the invention resides in a film processing envelope formed from a single preglued web and comprising a generally rectangular back panel; a generally rectangular front panel overlying the back panel and secured to the back panel adhesively along opposite edges and by means of a fold line along a third edge; a closure flap secured to the back panel by a fold line along a fourth edge opposite the third edge; means for securing the free edge of the closure flap opposite the fold line to the front panel when the closure flap is folded to overlie at least a part of the front panel; and means detachable from the closure flap to serve as a receipt, claim check, or the like.

In a more specific aspect, the invention resides in a film processing envelope formed from a single preglued web comprising a generally rectangular back panel; a generally rectangular front panel overlying the back panel and secured to the back panel adhesively along opposite edges and by means of a fold line along a third edge; a relatively shallow, open topped pouch having a back detachably secured along its top to the free edge of the front panel, and a front connected to the bottom edge of the back along a fold line, with the front and back being adhesively connected along opposite sides; a closure flap secured to the back panel by a fold line along a fourth edge opposite the third edge and adapted to extend beyond the pouch when the closure flap is folded over the front panel; and means for securing the free edge of the closure flap opposite the fold line to the front panel. The closure flap may be provided with a segment detachably secured therefrom to serve as a customer receipt, claim check or the like.

In drawings which illustrate the invention,

Figure 12:
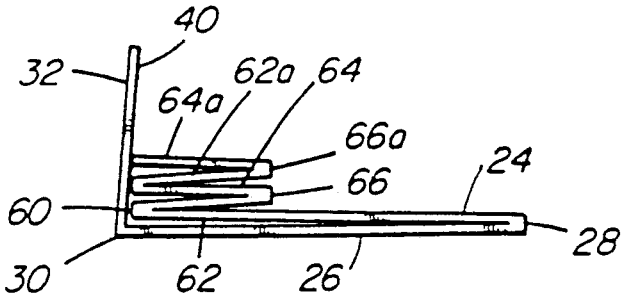
Figure 11:
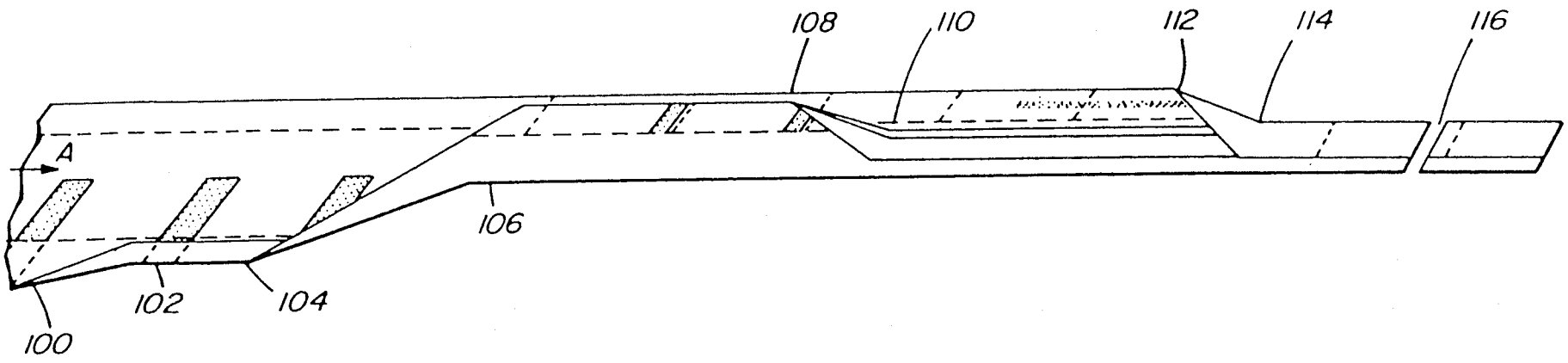

FIG. 11 schematically illustrates the formation of an envelope with detachable negative pouch; and FIG. 12 is a side view of another embodiment of an envelope with detachable negative pouch, folded but not glued.

Figure 1:
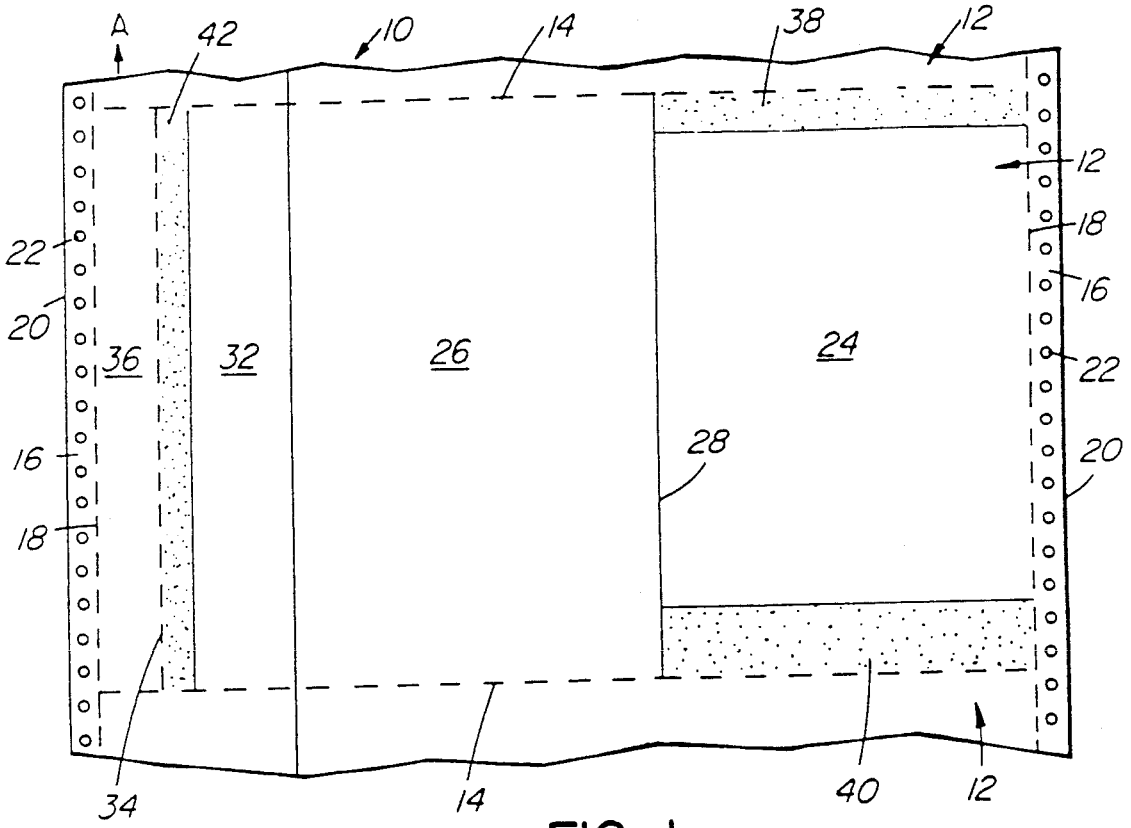
FIG. 1 is a plan view of a length of continuous preglued web illustrating complete envelope blank.
Figure 2:
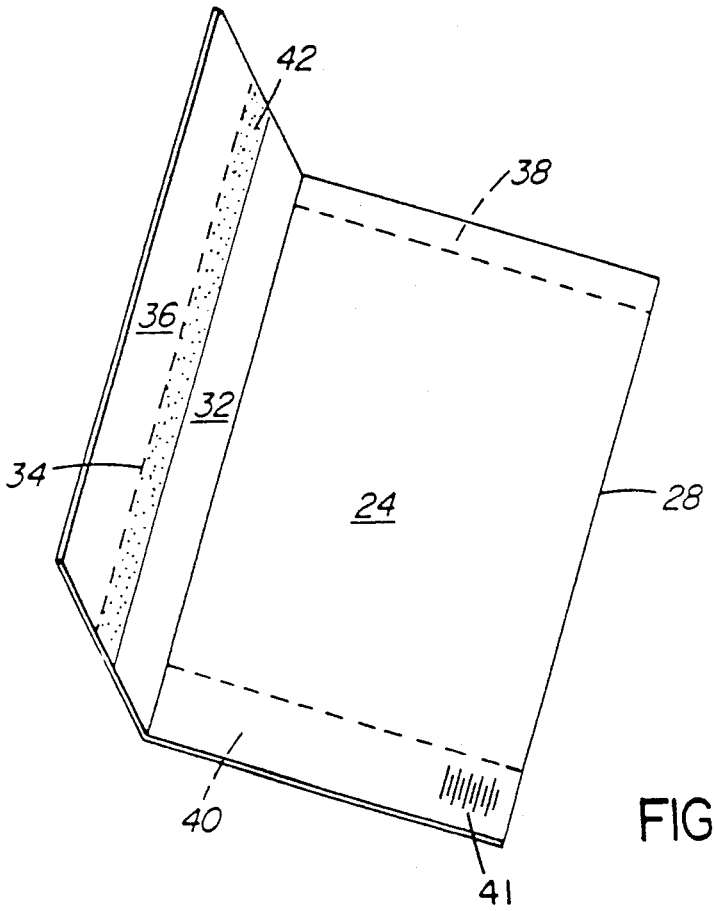
FIG. 2 is a pictorial view showing an envelope formed from the blank of FIG. 1.

With reference now to FIGS. 1 and 2 of the drawings, FIG. 1 illustrates a continuous web 10 which includes individual envelope blanks or forms 12 separated by transverse lines of perforations 14. The continuous web is formed with longitudinally extending marginal feed strips 16 on either side thereof, defined by longitudinally extending lines of perforations 18, and a lateral edge 20. The marginal feed strips are provided with a plurality of longitudinally spaced feed holes 22 which are adapted for engagement by conventional tractor drive devices utilized in business forms processing equipment for movement of the web in the longitudinal direction, for example, as indicated by the arrow A. The marginal feed strips are of course detachable from the web along the lines of perforations 18.

Each envelope form or blank comprises a rectangular front panel 24 and a back panel 26 of corresponding size and shape separated by a fold line 28. Adjoining the back panel along fold line 30 is a closure flap 32 to which is attached, through a line of perforations 34, a detachable extension, or stub, 36, which may serve as a receipt, claim check, or the like.

The front panel is provided with a relatively narrow adhesive strip 38 along one edge thereof and a relatively broad adhesive strip 40 along the opposite edge. Preferably the adhesive is of the heat activated variety and is designed to secure the front panel to the back panel along opposite sides when the front panel is folded about fold line 28 to overly the back panel 26 in order to form the pocket of the envelope.

Similarly, the closure flap is provided, among its outboard edge with an adhesive strip 42. The adhesive may be of any suitable type; typically, the adhesive will be either repositionable, moisture activated, or pressure sensitive. In the latter case it will be covered by a strip of removable release paper to prevent premature adhesion. It will be apparent to those skilled in the relevant art that various adhesives conventionally used in envelope and business form production will be suitable for both the closure flap 32 and the front and back panels 24 and 26. It will also be apparent that the panel adhesive can be applied either to the front panel or the back panel or to both, and that the adhesive strips need not necessarily be solid, but may, in so far as the panels are concerned, comprise various patterns which permit secure attachment of the front panel to the back panel. In so far as the closure flap adhesive is concerned, a repositionable adhesive may be preferable. Such an adhesive comprises a relatively low tack which strongly adheres to the closure flap, but less strongly adheres to the surface to which the flap is to be secured to permit repeated opening and closing of the flap should this be desirable.

FIG. 2 pictorially illustrates an envelope constructed from the form or blank illustrated in FIG. 1. FIG. 2 assumes the marginal feed strips 16 have been detached, and the front panel 24 is first folded about fold line 28 to overly back panel 26, and is secured thereto by means of the adhesive strips 38 and 40 to form the pocket of an envelope. The closure flap 32 and attached extension or stub 36 is then folded along line 30 to overly the back panel 24. Where the envelope is used as a film processing envelope, the extension or stub 36 comprises a customer receipt, claim check, or the like, and the relatively broad adhesive strip 40 results in the formation of the relatively wide solid double thickness side edge adapted to bear bar coding 41 information to facilitate use with a suitable bar code reading device for identification purposes and automated handling.

When a customer leaves film to be develop or processed, the film is deposited within the envelope, the stub 36, which is in the form of a customer receipt is removed from the closure flap 32 along the line of perforations 34 and given to the customer to use as a claim check when the customer returns for his processed film. The closure flap 32 is then folded over front panel 24 and the adhesive strip 42 is activated to secure the closure flap to the underlying surface of the front panel to seal the envelope with the contents therein.

Referring now to FIGS. 3 through 9, there is illustrated a film processing envelope similar in construction to that depicted in FIGS. 1 and 2, but incorporating a separate, removable, negative pouch. For simplicity of reference, the components of the envelope depicted in FIG. 3 through 9 which are common to the components of the envelope depicted in FIGS. 1 and 2 will bear like reference numerals. Accordingly, there is depicted a web 10 bearing a plurality of envelope forms or blanks 12 separated by transverse lines of perforations 14. Marginal feed strips 16 are provided, defined by longitudinally extending lines of perforations 18 and marginal edges 20, and carrying a plurality of feed holes 22. A front panel 24 is separated by a back panel 26 by fold line 28, and a closure flap 32 adjoins back panel 26 along fold line 30. To one edge of front panel 24 is applied a relatively narrow adhesive strip 38, and to the opposite edge is applied a relatively broad adhesive strip 40. The foregoing is substantially the same as the envelope form depicted in FIG. 1. However, there are differences in the closure flap and provision has been included for the addition of the negative pouch as will be hereafter described.

Referring to closure flap 32 there is provided, along one side thereof, and spaced inwardly a distance corresponding to the width of adhesive strip 40, a line of perforations 50 extending from fold line 30 to the longitudinal line of perforations 18, and, between the line of perforations 50 and the transverse line of perforations 14 and coincident with fold line 30, is a further line of perforation 52. The strip of adhesive 42 along the outboard of edge of closure flap 32 extends only as far as line of perforations 50, there being no closure flap adhesive 42 between the line of perforation 50 and the transverse lines of perforations 14. The closure flap is however provided with a further adhesive strip 54 in the area bounded by lines of perforations 50, 52 and 14 and the extension of the inboard edge of closure flap adhesive strip 42 which, for reference purposes, is designated **42*a* in FIG. 3**.

Figure 3:
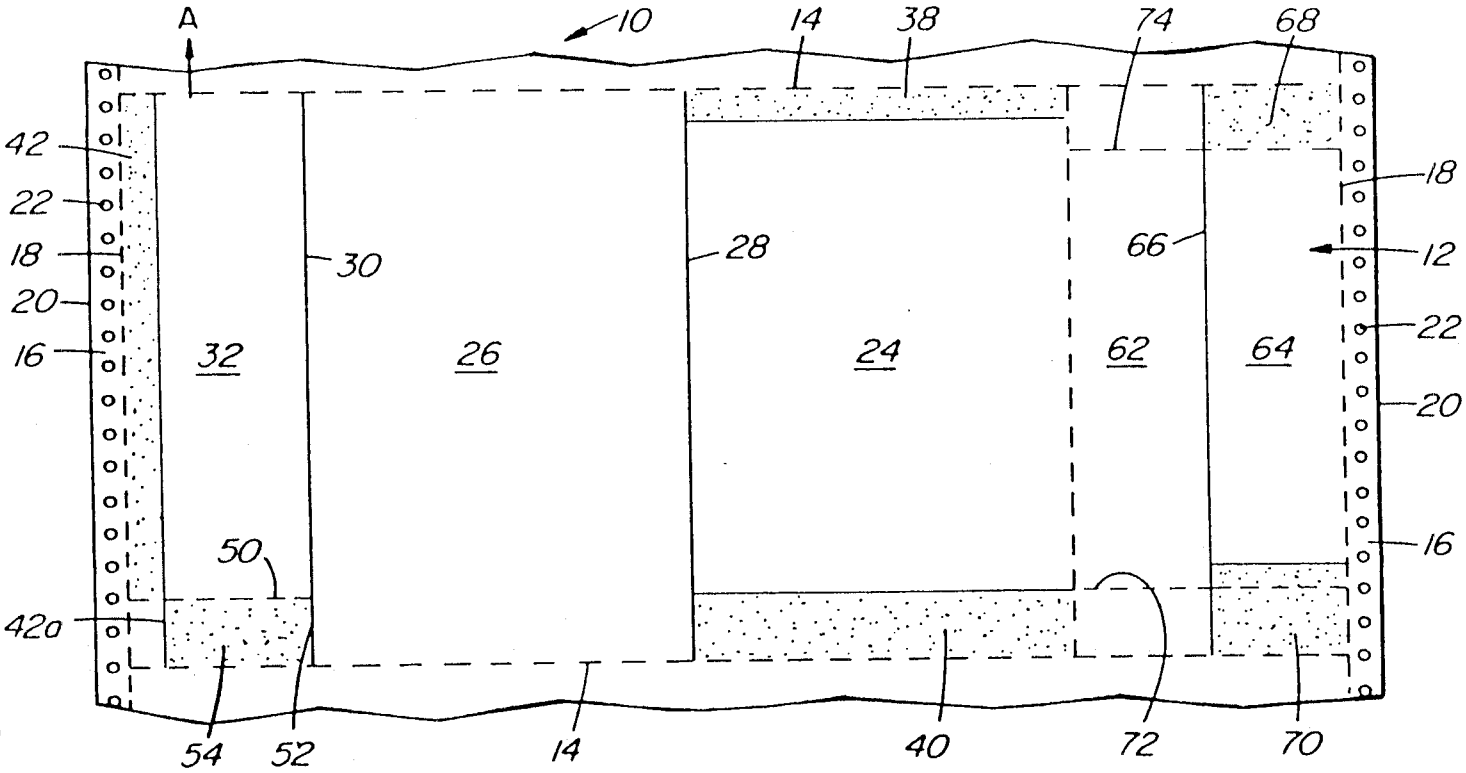
FIG. 3 is a plan view of a length of continuous preglued web illustrating a complete blank for the construction of an envelope with a detachable negative pouch.
Figure 3A:
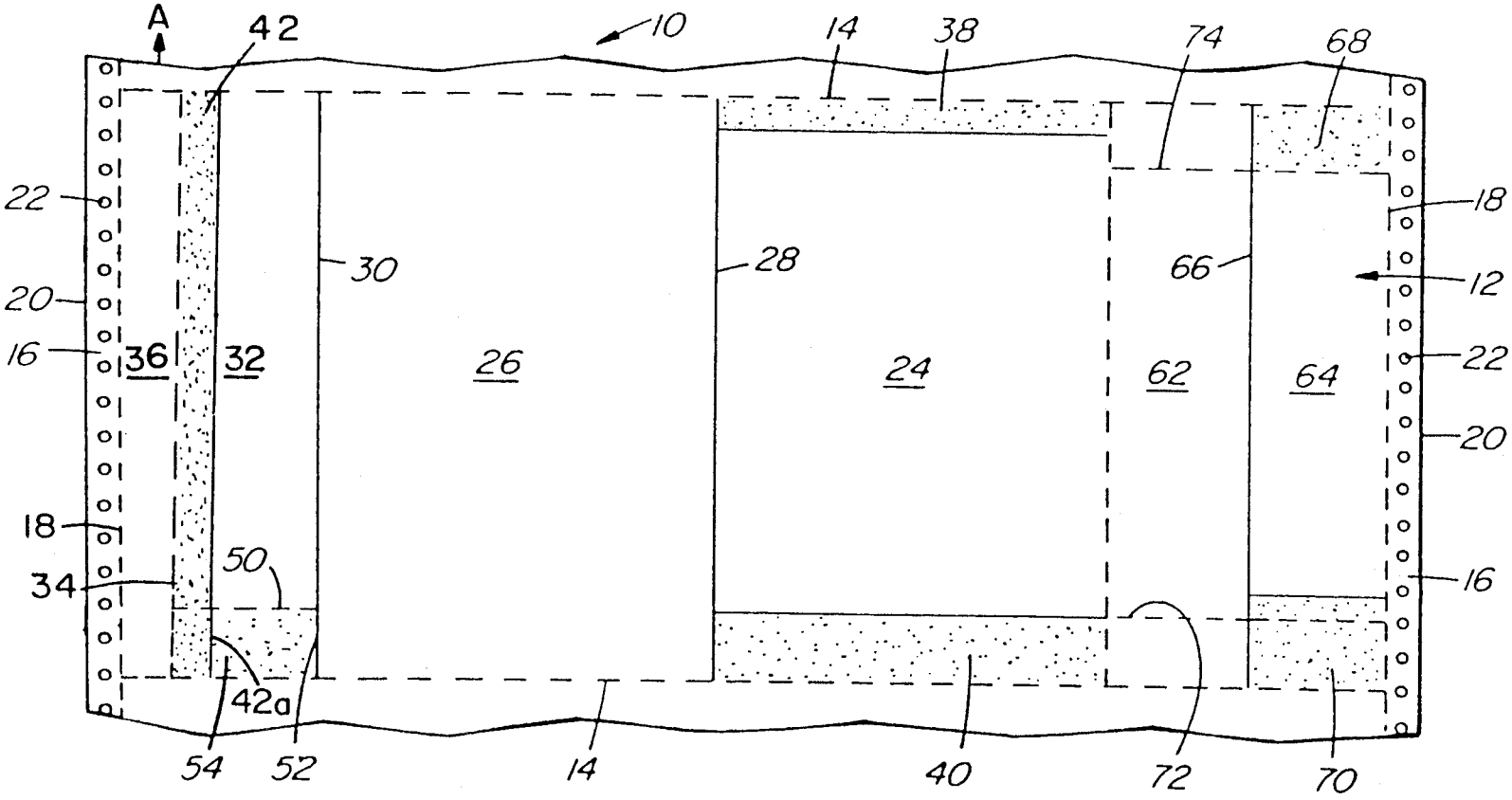
FIG. 3A is a partial plan view of a length of continuous preglued web of the type illustrated in FIG. 3, but with a detachable segment secured to the closure flap.

In FIG. 3A, there is illustrated a film processing envelope similar in construction to that depicted in FIG. 3 but incorporating a detachable extension or stub 36 of the type incorporated in the envelope blank of FIG. 1.

Connected to the outboard edge of front panel 24, through a line of perforations 18 is the back 62 of a negative pouch which, in turn, is connected to a negative pouch front 64 through a fold line 66. The front 64 is provided along one edge with an adhesive strip 68 greater in width than adhesive strip 38 of envelope front panel 24 and, along the opposite edge, with an adhesive strip 70 which is greater in width than adhesive strip 40 of envelope front panel 24. Transversely aligned with the line of perforations 50 on closure flap 32 is a line of perforations 72 extending across both negative pouch front and back 64 and 62, and, inboard of the adhesive strip 68 is a second line of perforations 74 extending across negative pouch front and back 64 and 62. As in the case of the envelope front and rear panels, the adhesive strips 68 and 70 may be applied to either of the negative pouch front and back 64 and 62, or to both, and may be of any suitable type, but, typically, is heat activated.

Figure 4:
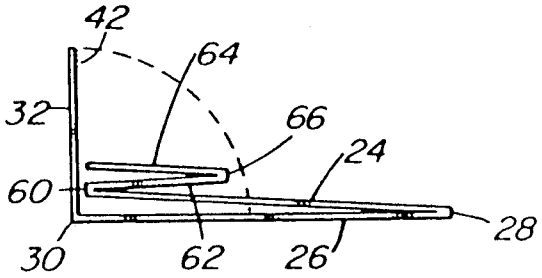
FIG. 4 is a side view illustrating an envelope with detachable negative pouch folded from the blank of FIG. 3, without being adhesively secured.

FIG. 4 depicts an envelope form or blank of the type depicted in FIG. 3 which has been loosely folded to illustrate the relationship of the various panels. It will be seen that envelope front panel 34 overlies envelope back panel 26 after folding about fold line 28. Negative pouch back 62 is foldably and detachably connected to the free edge of envelope front panel 24 along perforated line 60, and negative pouch front 64 is folded to overlie back 62 about fold line 66. Closure flap 32 is folded about fold line 30 to overlie the negative pouch formed by front and back 64 and 62. It will however be seen that the closure flap is so dimensioned that, when folded over, it will extend beyond the bottom of the negative pouch (as depicted by the dotted lines in FIG. 4) so that the adhesive strip 42 overlies, and may be secured directly to the envelope front panel 24. Preferably, the length of adhesive strip 54, between **42*a* and 52** will equal the depth of the negative pouch.

Figure 5:
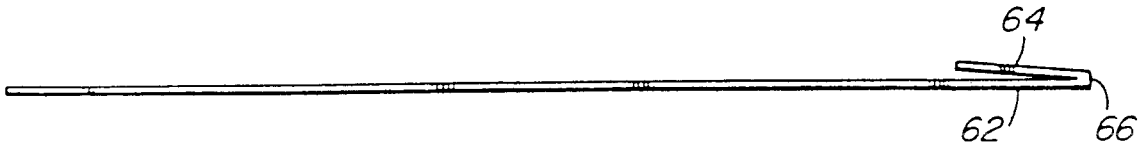
FIG. 5 is a side view of the envelope blank of FIG. 3 after a first folding step.

FIG. 5 through 8 schematically depict the steps in the formation of an envelope with detachable negative pouch. In FIG. 5, negative pouch front 64 is folded about line 66 over back 62.

Figure 6:
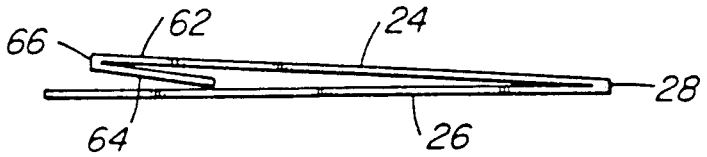
FIG. 6 is a side view of the envelope blank of FIG. 3 after a second folding step.

In FIG. 6, envelope front panel 24, with negative pouch attached is folded over envelope back panel 26 about fold line 28.

Figure 7:
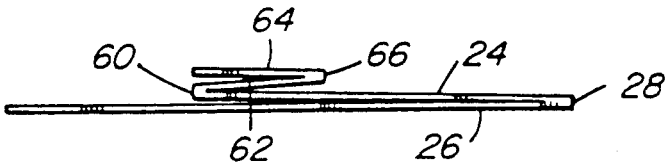
FIG. 7 is a side view of the envelope blank of FIG. 3 after a third folding step.

In FIG. 7 the negative pouch back 62 is folded back over envelope front panel 24 about fold line 60. It will be seen that the film processing envelope is now formed as well as the detachable negative pouch.

Figure 8:
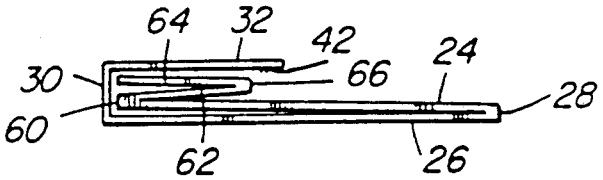
FIG. 8 is a side view of the envelope blank of FIG. 3 after a fourth folding step.

Finally, in FIG. 8, closure flap 32 is shown folded about fold line 30 over the negative pouch and a portion of the envelope front panel 24 to close both the envelope and the negative pouch. Assuming all of the adhesive strips are now activated, a sealed envelope including a negative pouch is now complete and will appear in front view as shown in FIG. 8.

While folding of the envelope with negative pouch is illustrated in FIGS. 5 through 8 in terms of an individual envelope in a step by step operation, in practice the folding and envelope formation will be conducted, as depicted in FIG. 11, in a continuous operation on a continuous web of preprinted and preglued material travelling in the direction of arrow A in FIG. 11. Plough folding of the negative pouch front and back about fold line 66 commences at 100 and terminates at 102. Plough folding of the envelope front and back panels 24 and 26 about fold line 28 commences at 104 and terminates at 106. Plough folding of the negative pouch back over the envelope front panel 24 about fold line 60 commences at 108 and is completed at 110 and plough folding of the closure flap about fold line 30 over the negative pouch and the envelope front panel 24 commences at 112 and concludes and 114. The envelope and negative pouch glues are activated during folding, or at the end of the folding operation to produce complete envelopes and pouches. The closure flap adhesive of course is not activated. Individual envelopes are then cut-off or separated from the folded and glued continuous web at 116.

Figure 10:
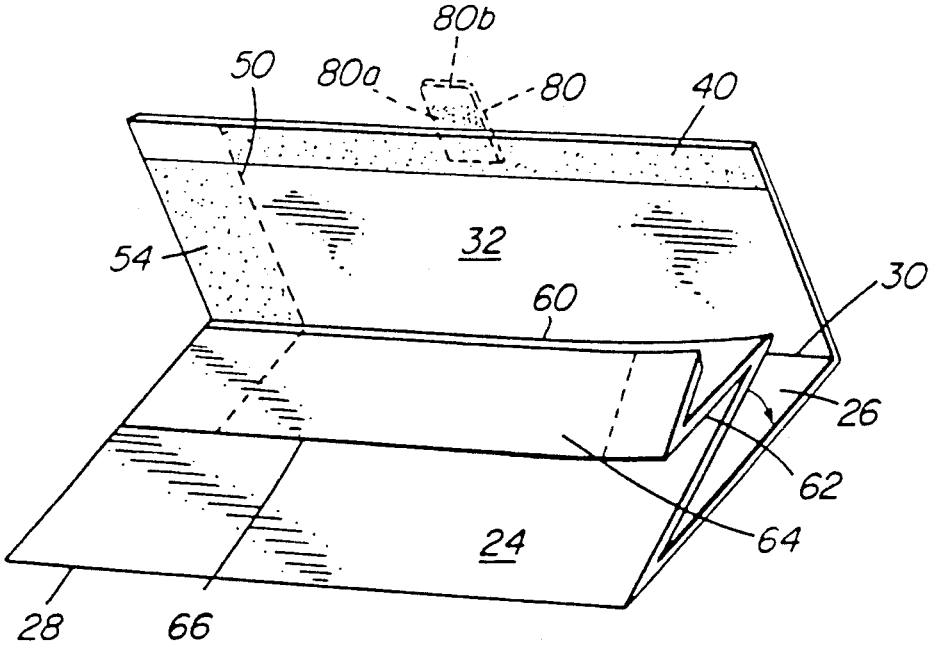
FIG. 10 is a pictorial view illustrating an envelope with detachable pouch the left hand end which is shown adhesively secured and the right hand end of which is illustrated prior to adhesive securement.

FIG. 10 schematically illustrates the envelope and negative pocket combination resulting from the foregoing operation with the closure flap unsealed and with the remainder of the envelope and negative pouch sealed at the left hand end and, for illustrative purposes, unsealed at the right hand end.

Figure 9:
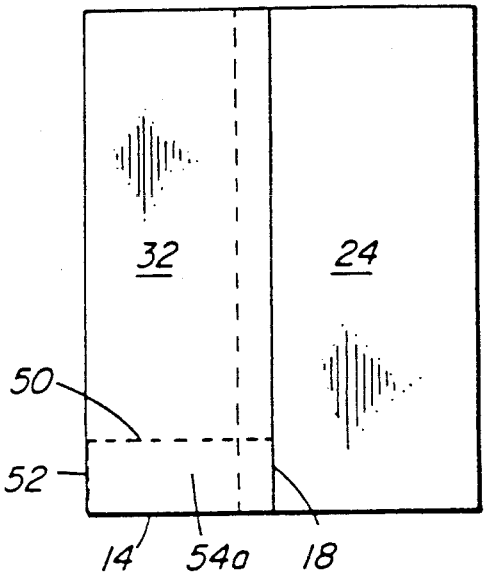
FIG. 9 is a front view of a folded envelope with detachable negative pouch.

As will appear from FIG. 10, and FIG. 9, when sealed, the envelope front panel 24 and back panel 26 are secured along fold line 28 as well as opposite side edges by means of the relatively narrow and relatively broad adhesive strips 38 and 40 previously described, and the top of the envelope opposite fold line 28, before sealing of the closure flap, is open to receive the contents comprising prints, advertising or promotional materials or the like. Similarly, the front and rear negative pouch panels 64 and 62 are joined along fold line 66, and, at opposite sides, along relatively narrow and relatively broad adhesive strip 68 and 70. Prior to sealing of the closure flap, the top of the negative pouch is open to receive negative strips or the like.

Apart from its connection through fold line 60 the negative pouch is not connected to the envelope, although it is connected to the closure flap as will hereafter be described. As fold line 60 comprises a line of perforations, the envelope pouch may be readily detached from the envelope simply by tearing along the line of perforations 60.

When the enclosure flap 32 is folded over the negative pouch and envelope front panel 24 about fold line 30, and the adhesive strip 54 is activated the adhesive strip 54 will secure that portion of the closure flap to the front 64 of the negative pouch, and, by reason of the aligned lines of perforation 52 and 60, and the aligned lines of perforations 50 and 72, the adhesively secured portions of the closure flap and the underlying negative pouch bounded by the lines 50, 52, 14 and 18 depicted in FIG. 9 may be physically separated from the remainder of the closure flap to form a receipt or claim check to be given to a customer or to be retained for record purposes by the film processing outlet. The unglued portion of the closure flap bounded by the lines 14, 18, 40*a* and 50 in FIG. 3 permits this stub portion to be readily grasped by a clerk for removal of the receipt or stub identified by the numeral 54*a* in FIG. 9. When this stub portion has been removed, the closure flap is disconnected from the negative pouch, which then becomes accessible until the closure flap is sealed to the front envelope panel 24 along adhesive strip 42. If adhesive strip 42 comprises a strip of repositionable adhesive, the closure flap may be selectively sealed and unsealed many times giving access to both the contents of the envelope and the contents of the negative pouch. The negative pouch remains intact, because adhesive strip 70 extends beyond or inboard of the line of perforation 72, so that both opposite sides of the negative pouch remain sealed. However, if a customer decides to store the negative pouch separately, it may be completely detached from the envelope along line 60. Additionally, should a customer wish to store the negative pouch and the negatives contained therein inside the film envelope, the negative pouch may be torn along line of perforations 74, which is inboard of the glue strip 68, to produce a pouch which is open at that side edge but which is shorter than the open mouth of the envelope, so that the open ended pouch may be stored inside the envelope.

It will be appreciated that prior to formation, the continuous web of which the envelope or envelope with pouch is formed may be preprinted with all necessary fixed and variable information on each envelope in a conventional manner. As noted previously, the broad adhesive strip 40 provides a wide, relatively stiff envelope edge to which bar coding information can be applied, and which will be admirably suited to passage through a bar code reader for control purposes. The body of the envelope will contain numerical or like indicia which corresponds to similar indicia on the removable receipt or claim check component so that the one can be compared with the other.

As will be appreciated, many variations of the construction disclosed herein are possible without departing from the scope of the invention. For example, one such variation is depicted in FIG. 10 wherein the closure flap adhesive strip 42 may be replaced by a closure tab shown in dotted lines at 80, one end of which is permanently secured to the envelope closure flap 32, and the other end of which projects therefrom and has adhesive applied to the face thereof adapted to contact envelope front panel 24 so that the tab may be used to seal the flap over the pouch and envelope rather than adhesive strip 42. Preferably a repositionable adhesive is utilized so that the closure flap may be opened and closed repeatedly. To facilitate this, the adhesive is applied only to section 80*a* of the tab, leaving section 80*b* free of adhesive so that it will not be secured to the envelope front panel 24 and may be readily grasped to strip back the tab to open the envelope and provide access thereto as well as to the attached negative pouch.

It will be appreciated that the envelope with negative pouch may be provided to a film processing outlet with all adhesive strips activated with the exception of the adhesive strip 40 or the closure tab 80. When given a roll of film for developing by a customer or when being provided with negatives to be reprinted, the film processing outlet will remove the stub 54*a* comprising the receipt or claim check to give to the customer. The roll of undeveloped film will then be deposited inside the envelope, or the negatives will be inserted in the negative pouch, and the closure flap folded over and sealed. The undeveloped film or negatives are then in due course removed for processing and the resulting prints inserted in the envelope, with the negatives being inserted in the negative pouch, the closure flap is then resealed and returned to the processing outlet to be picked up by the customer. The customer will of course produce the receipt or claim check which will correspond to identical data appearing on the envelope to ensure that the correct prints color negatives, etc. are delivered to the correct customer. When used in this manner, it will of course be important that repositionable adhesive be employed on closure flap adhesive strip 42 or on the closure tab 80 so that the closure flap may be reopened and reclosed for removal of, and retention of, the contents.

It will also be apparent that extra negative pouches may be provided simply by duplicating the negative pouch components illustrated in FIG. 3 and connecting them through a further fold line to front 64 depicted in that Figure. FIG. 12 schematically depicts an envelope with double pouch, the extra pouch being formed of front 54*a* and back 62*a* folded about a fold line 66*a* and connected to first negative pouch front 64 through a further fold line 60*a*. The second pouch may be virtually identical to the first, and even further pouches could be added if desired.

The embodiments of the invention in which an exclusive property or privilege is claimed are defined as follows:

1. A film processing envelope formed from a single preglued web comprising:

a generally rectangular back panel;

a generally rectangular front panel overlying said back panel and adhesively secured to said back panel along opposite edges, and secured to said back panel by a fold line along a third edge, wherein the adhesive securement between said front and back panels comprises a strip of adhesive on one of said panels along said opposite edges, the strip along one edge being substantially broader than the strip along the other, to thereby provide a relatively stiff envelope portion along said one edge;

a closure flap secured to said back panel by a fold line along a fourth edge opposite said third edge;

means for securing the free edge of said closure flap opposite said fold line to said front panel;

and an extension of said closure flap detachably secured thereto.

2. A film processing envelope in accordance with claim 1, wherein said third and fourth edges are substantially longer than said opposite edges.

3. A film processing envelope in accordance with claim 1, wherein said means for securing the free end of said closure flap to said front panel comprises an adhesive strip along said free edge.

4. A film processing envelope in accordance with claim 1, wherein said means for securing the free end of said closure flap comprises a tab secured to said closure flap and projecting therefrom, said projecting portion bearing repositionable adhesive for attachment to said front panel.

5. A film processing envelope in accordance with claim 1, wherein said extension comprises a strip coextensive with the free edge of said closure flap and secured thereto along a line of perforations.

6. A film processing envelope in accordance with claim 1, wherein at least one of said envelope panels bears bar code data imprinted on the outer envelope surface thereof overlying the broad strip of adhesive securement.

7. A film processing envelope formed of a single preglued rectangular web comprising:

a rectangular back panel;

a rectangular front panel overlying said back panel and adhesively secured to said back panel along opposite edges, and secured to said back panel by a fold line along a third edge;

a relatively shallow, open topped pouch having a back detachably secured along its top to the free edge of said front panel, and a front connected to the bottom edge of said back along a fold line, said front and back being adhesively connected along opposite sides;

a closure flap secured to said back panel by a fold line along a fourth edge opposite said third edge and adapted to extend beyond said pouch when folded over said envelope front panel;

an extension of said closure flap, removably secured thereto;

and means for securing the free edge of said closure flap opposite said fold line to said front panel, wherein the adhesive securement between said envelope front and back panels and said pouch front and back comprises a strip of adhesive on one of said panels along said opposite edges, and on one of said pouch front and back along said sides, the strip along one edge and the adjacent side being substantially broader than the strip along the other edge and side, with the broad strip along the side of the pouch being broader than the broad strip along the edge of the envelope.

8. A film processing envelope in accordance with claim 7, wherein said envelope third and fourth edges are substantially longer than said opposite edges.

9. A film processing envelope in accordance with claim 7 wherein said means for securing the free end, said closure flap comprises an adhesive strip along said free edge, and spaced from said fold line a distance at least equal to the depth of said pouch.

10. A film processing envelope in accordance with claim 8, wherein said means for securing the free end of said closure flap to said envelope front panel comprises a tab secured to said closure flap and projecting therefrom, said projecting portion bearing repositionable adhesive for attachment to said front panel.

11. A film processing envelope in accordance with claim 10, wherein the outboard end of said tab is free of adhesive.

12. A film processing envelope in accordance with claim 8, wherein said extension comprises a strip coextensive with the end of said closure flap adjacent said broad strip of adhesive securement, and is secured to said closure flap along a line of perforations coinciding with the inboard edge of said broad strip of adhesive on said envelope.

13. A film processing envelope in accordance with claim 12, wherein the surface of said extension overlying said pouch when said closure flap is folded to overlie said envelope front panel, is provided with an area of adhesive coextensive with the depth of said pouch.

14. A film processing envelope in accordance with claim 13, wherein said extension is detachably secured to said envelope back panel along a line of perforations coincident with said fold line.

15. A film processing envelope in accordance with claim 14, wherein said pouch is detachably secured to said free edge of said envelope front panel along a line of perforations.

16. A film processing envelope in accordance with claim 7, wherein at least one of said envelope panels bears bar code data imprinted on the outer envelope surface thereof overlying the broad strip of adhesive securement.

17. A film processing envelope in accordance with claim 15 wherein at least one of said envelope panels bears bar code data imprinted on the outer envelope surface thereof overlying the broad strip of adhesive securement.

18. A film processing envelope in accordance with claim 7 wherein at least one of said envelope panels bears bar code data imprinted on the outer envelope surface thereof overlying the broad strip of adhesive securement.

* * * * *